US005864190A

United States Patent [19]

Bacchiocchi

[11] Patent Number: 5,864,190

[45] Date of Patent: Jan. 26, 1999

[54] DOUBLE OR MULTIPLE AUGER SUCTION UNIT FOR HOODS, OVENS AND SIMILAR APPLIANCES

[75] Inventor: Alberto Bacchiocchi, Castelfidardo, Italy

[73] Assignee: F.I.M.E.—Fabrica Italiana Motori Elettrici S.R.L., Italy

[21] Appl. No.: 982,960

[22] Filed: Dec. 2, 1997

[30] Foreign Application Priority Data

Dec. 6, 1996 [IT] Italy ..... MC96U000048 U

[51] Int. Cl.[6] ..... H02K 5/04; F04D 29/42

[52] U.S. Cl. ..... 310/89; 310/62; 415/182.1; 415/214.1

[58] Field of Search ..... 415/182.1, 203, 415/213.1, 214.1; 310/89, 62

[56] References Cited

U.S. PATENT DOCUMENTS

| | | | |
|---|---|---|---|
| 2,710,573 | 6/1955 | Marker | 415/203 |
| 3,469,772 | 9/1969 | McDonald | 415/203 |
| 3,874,191 | 4/1975 | Hudson | 415/219 |
| 4,599,042 | 7/1986 | Colliver | 415/204 |
| 5,257,904 | 11/1993 | Sullivan | 415/214.1 |

*Primary Examiner*—Nestor Ramirez
*Assistant Examiner*—B. Mullins
*Attorney, Agent, or Firm*—Leonard Bloom

[57] ABSTRACT

This invention concerns a suction unit for hoods, ovens and similar appliances having a double auger casing consisting of two sectional half-shells, namely a top and a bottom shell which ensure easy assembly and automatic centring on a fan-motor unit entirely housed in the casing.

2 Claims, 6 Drawing Sheets

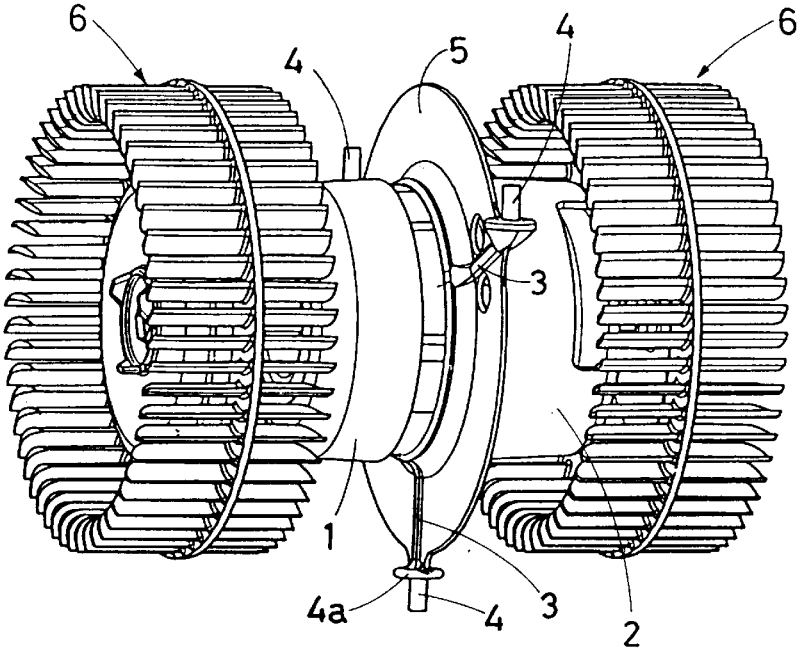
FIG. 1
FIG. 2
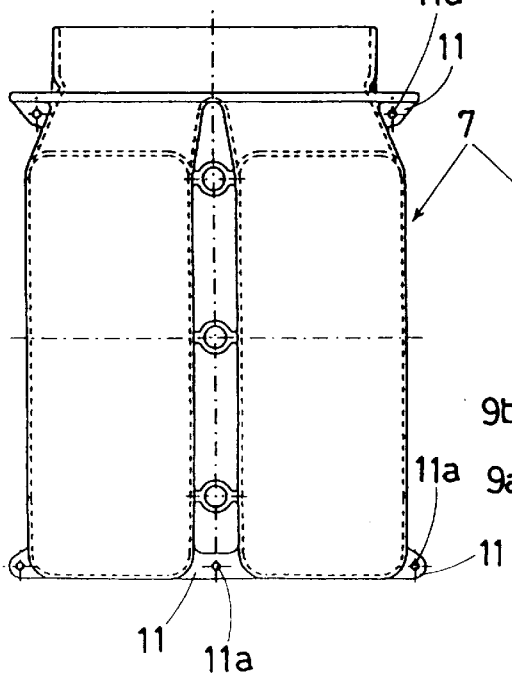
FIG. 3
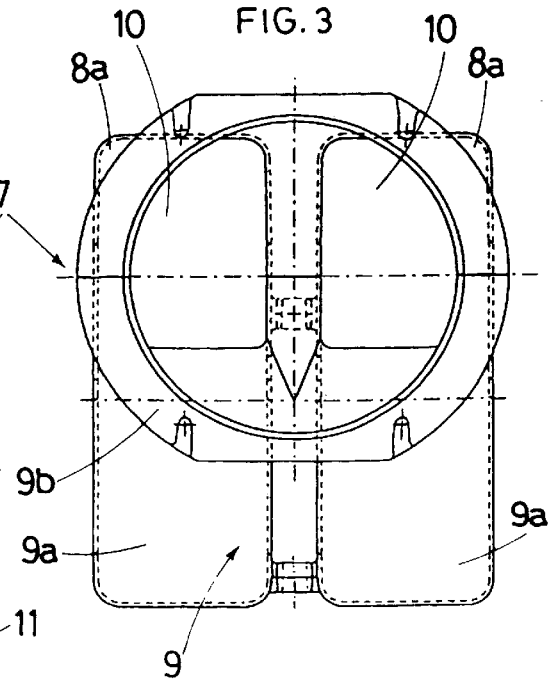

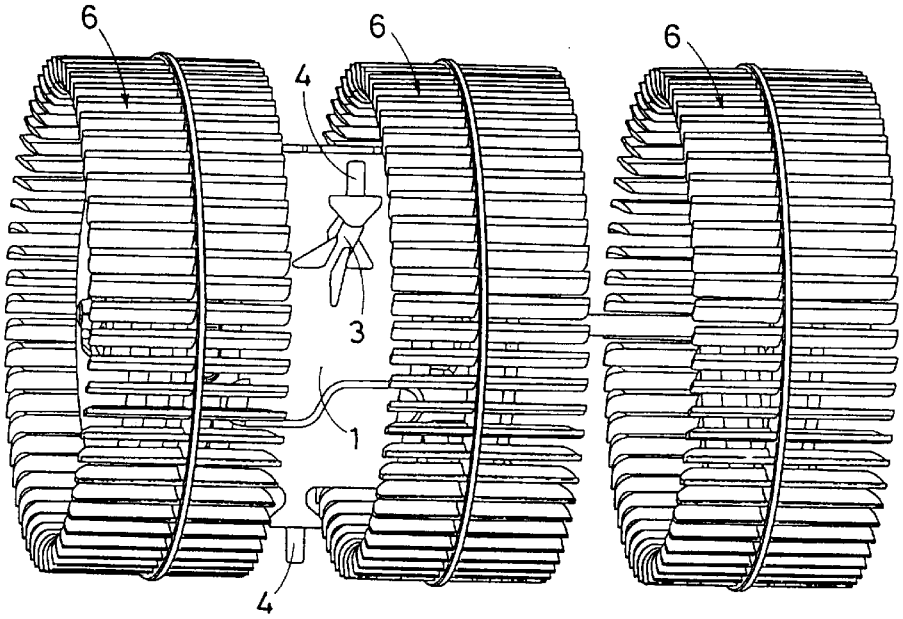
FIG. 1A
FIG. 2A
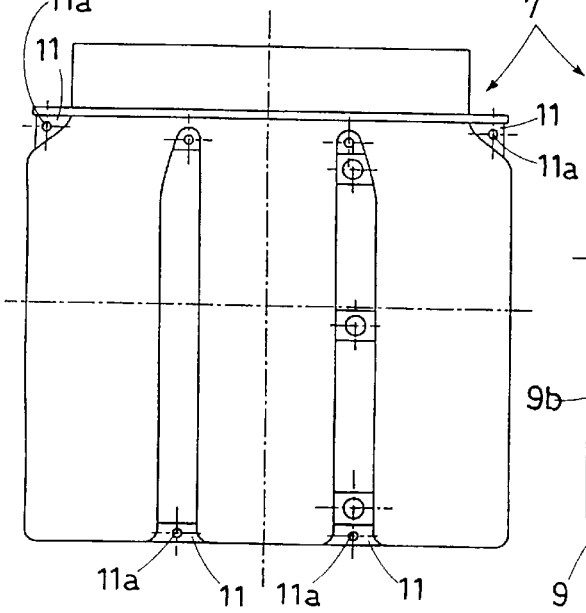
FIG. 3A
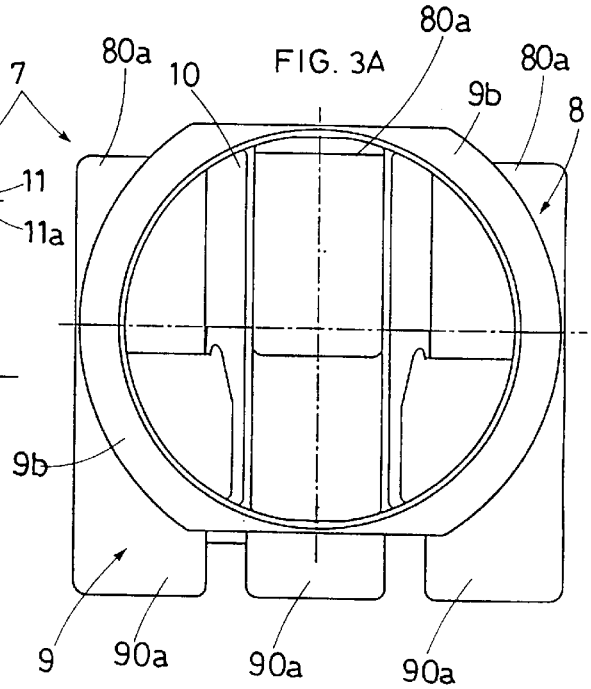

DOUBLE OR MULTIPLE AUGER SUCTION UNIT FOR HOODS, OVENS AND SIMILAR APPLIANCES

This patent application concerns a suction unit for hoods, ovens and similar appliances: it involves a powerful suction unit of the type having an electric motor which simultaneously operates several fans mounted along its sides.

In particular the ends of a shaft on which the fans are splined project horizontally from the sides of said motor.

Currently suction units of this kind are provided with a special casing consisting of two adjacent augers each of which houses a fan; it being provided that the motor driving the two fans is flush mounted at the centre of said casing.

Moreover the casing is provided with a wide circular nosepiece which joins the outflow holes at the outlet of the two augers to a pipe through which the suction air is discharged.

Suction units of this type have to date proved to be quite efficient even if they are fairly difficult to construct and assemble especially with respect to their external double auger casing.

This type of casing in fact consists of five components: two box shaped bodies each consisting of a plate having an eccentric hole and a perimeter spiral shaped edge from which a rim placed at 90° projects, two perforated covers abutting and screwed on the perimeter rim of the box shaped bodies and a circular connection nosepiece.

The problems related to mounting these casings are evidently appreciable; in particular the two box shaped bodies are particularly difficult to fit and fix to the sides of the motor in the position required to house the relevant fans.

By means of the eccentric hole on the same, the two box shaped bodies must be fitted onto the two sections of the shaft projecting on the right and on the left of the motor.

In order to carry out this operation it is necessary to keep the perimeter edge of the two box shaped bodies turned outwards so that at the end of the mounting operation the two flat faces of the box shaped bodies almost touch each other and the eccentric holes are perfectly aligned.

In this way the motor is positioned at the centre of the casing, in the space created by said holes, while the two suction fans are housed precisely in the internal compartment of the box shaped bodies enclosed by the respective perimeter edges.

The covers must then be abutted and screwed against the perimeter edge of the box shaped bodies so that each fan is housed and protected between the internal face of the relevant box shaped body and the internal face of the cover.

As mentioned previously said covers are provided with respective holes which allow air to flow into the casing once the fans have been activated.

The last assembly operation consists of fixing the nosepiece which acts as connection between the casing and the pipe discharging air to the exterior, to the pair of outlet holes of the two augers.

A particularly critical operation in these conventional units is fixing the two box shaped bodies securely to the motor which acts as a supporting structure.

In particular the motor is housed in a cover from which a series of radial arms project and whose ends must be screwed to the bottom plate of each of the two box shaped bodies.

This operation is particularly difficult especially in terms of centring the casing in question precisely with respect to the supporting motor.

The purpose of this invention is to radically simplify the assembly method and structure of a double auger suction unit.

A further scope of the invention is to design a suction unit having more than two adjacent augers without increasing the assembly times proportionally to the number of augers mounted.

The suction unit according to the invention has a multiple auger shaped casing but consists of only two components instead of the five required in the case of conventional casings.

These two components consist of two half-shells mounted on the fan-motor but not on the right and on the left as in the case of the conventional technique - but one above and one below.

In order to explain the structure of the half-shells it is necessary to point out that the same are realised as though a hypothetical monoblock casing consisting of two or more augers and provided with the relevant connection nosepiece were divided into two equal sections on a horizontal centre plane.

Each of said half-shells in fact consists of two or more semi-augers positioned adjacent at a short distance from each other as well as of a semi-nosepiece at the outlet hole of the adjacent pair of semi-augers.

In this sense it is therefore possible to talk of a top half-shell and a lower half-shell.

Thus, simply by making the mouth of the top half-shell touch against the mouth of the lower half-shell it is possible to form the casing having two or more augers placed adjacent and close to each other and complete with the necessary connection nosepiece.

It is therefore sufficient to join the two half-shells by means of screws having vertical axis which are inserted into the several perforated gusset plates with which the two items are provided externally in corresponding positions.

This assembly operation of the casing must naturally be performed by positioning the fan-motor between the two half-shells.

Moreover, with reference to the unit according to the invention, it should be noted that said fan-motor unit acts as a supporting structure; the way in which the relevant casing is fixed to said unit is however different with respect to prior techniques.

The fixing method in question in particular is much easier and faster and ensures precise and automatic centring of the external casing and motor.

The motor is in fact generally housed in a cylindrical cover from which three arms of identical length placed at 120° project radially and whose ends are provided with relevant pins having vertical axis, two of which face upwards and one downwards.

The first two pins, namely those facing upwards, are housed in corresponding bushings positioned therefor in the space between the semi-augers of the top half- shell while the third pin, namely the one facing downwards is housed in a corresponding bushing in the space between the semi-auger of the bottom half- shell.

This means that when the two half-shells are placed from top to bottom with respect to the fan-motor unit, it is important to ensure that the bushings between the adjacent pairs of semi-augers and the corresponding pins are precisely aligned.

It is interesting to note moreover that the structure and the dimensions of the motor unit and the casing are designed so that when the three pins are housed precisely into the relevant bushings, the mouth of the top half-shell touches precisely against the mouth of the bottom half-shell.

Another advantage of the suction unit according to the invention is evident from the above.

In fact when the two half-shells are locked, the fan-motor unit is automatically centred and stopped whereas in the case of the prior technique two separate and more complex operations were required: one to stop the fan-motor unit and the other to assemble the external casing.

In a preferred embodiment of the invention the above radial arms projecting from the motor cover may be housed in a disk arranged edgewise around the cover itself.

This disk in no way interferes with the assembly of the two half-shells on the fan-motor in that it is housed in the space of the casing between the augers.

It is important to explain the particular function of this disk in terms of accident prevention; its presence between the augers in fact prevents accidental insertion of a hand in the eccentric holes of the augers and thus makes it impossible for an operator to touch the fans in said augers.

For major clarity the description of the invention continues with reference to the enclosed drawings which are intended for purposes of illustration and not in a limiting sense in which two structurally different embodiments of the same invention are illustrated, one consisting of two augers and two fans and the other consisting of three augers and three fans:

FIG. 1 is an axonometric view of the motor and the two fans of the suction unit according to the invention; FIG. 2 is a top view of the casing of the suction unit according to the invention;

FIG. 3 is a view of the casing on the nosepiece side;

Figure 5:
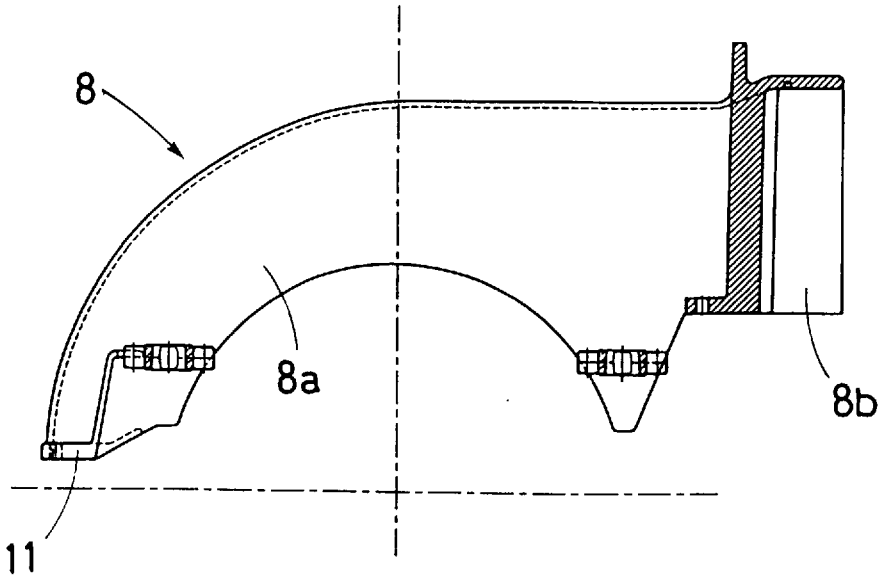
FIG. 5 is a cross-section of FIG. 4 on plane V—V.
Figure 6:
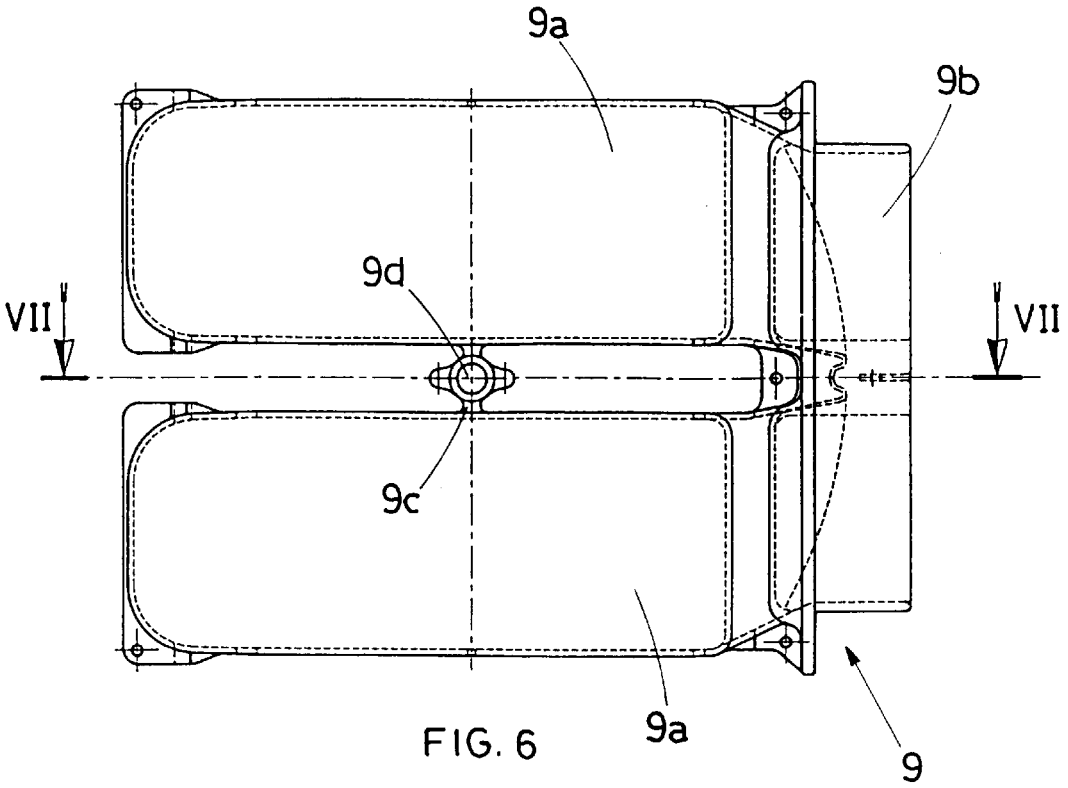
FIG. 6 is an external view of the bottom half-shell of the casing.
Figure 7:
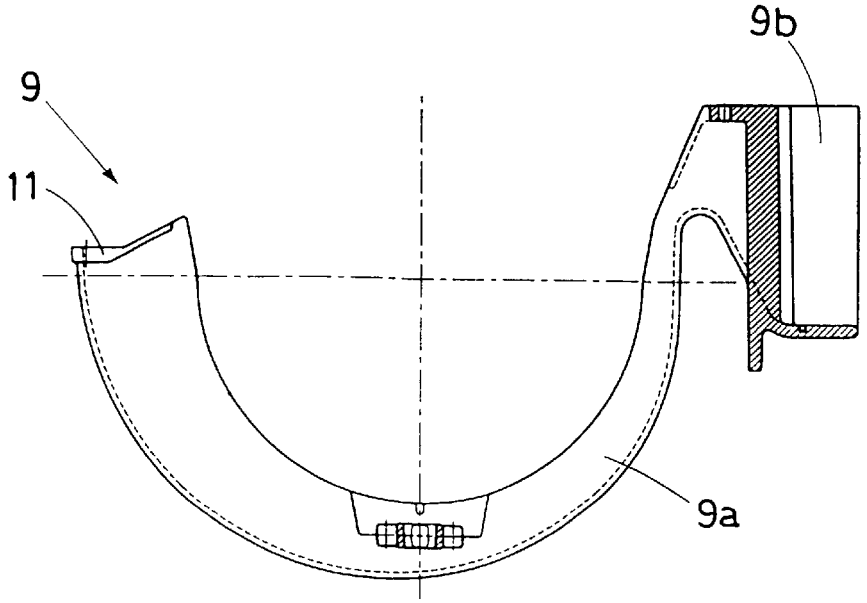
FIG. 7 is the cross-section of FIG. 6 on plane VII—VII.
Figure 7A:
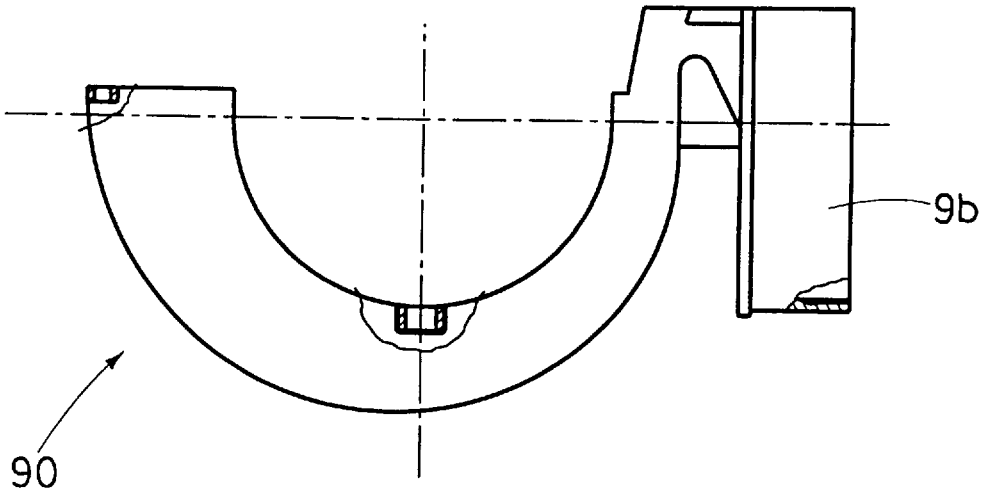
Figure 6A:
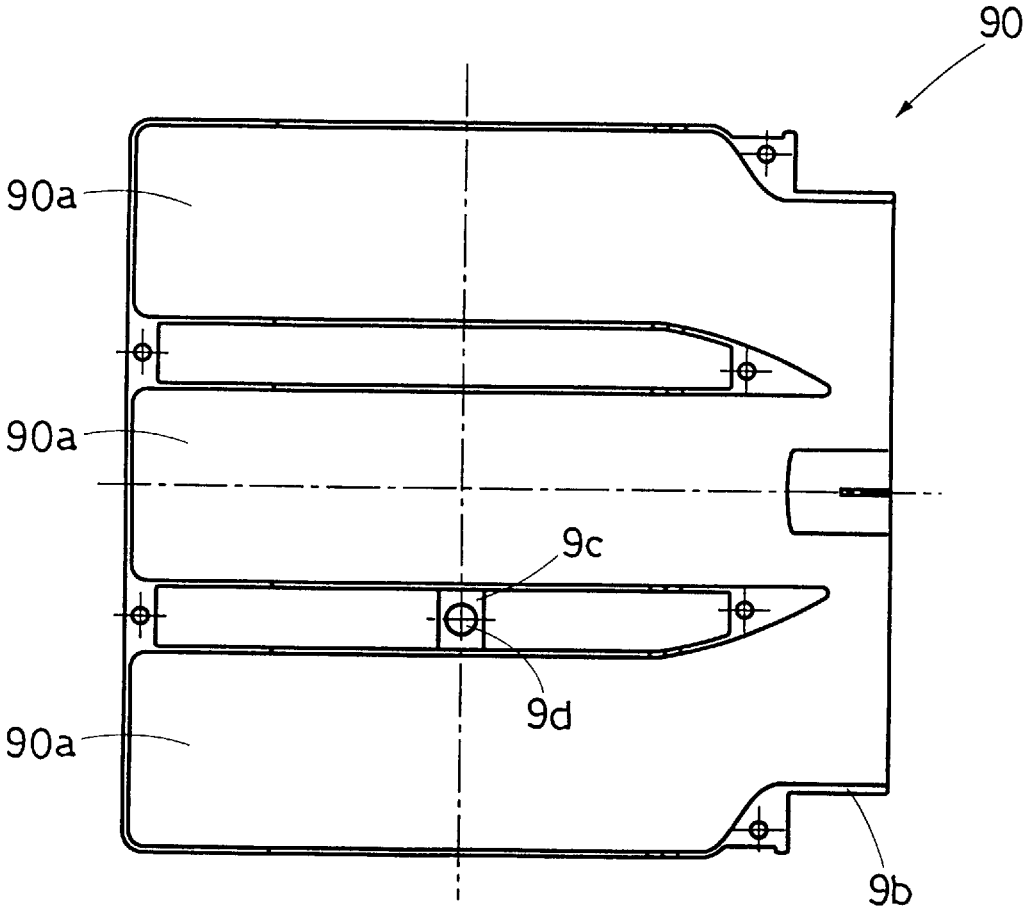

FIGS. 1A and 7A correspond to FIGS. 1–7 but refer to the second structural embodiment of the invention which consists of a motor, three augers and three fans.

With reference to FIG. 1, the motor (1) of the suction unit in question is in part housed in a cylindrical cover (2) provided externally with three radial arms (3) placed at 120° of which two are turned upwards and one is turned downwards, all terminating with respective pins having vertical axis (4) each having an enlarged end base (4*a*).

In the embodiment of the invention illustrated in FIG. 1, said radial arms (3) are provided with disk (5) realised outside the cylindrical cover (2) which has an accident prevention function as described previously.

Two fans (6) are splined on the ends of the through shaft of the motor (1)—and consequently on the right and on the left of the same. With reference to FIGS. 2–7, the casing (7) of the suction unit according to the invention consists of two half-shells, one at the top (8) and the other at the bottom (9), which are designed to touch against each other following insertion between the same of the motor (1) complete with fans (6).

Figure 4:
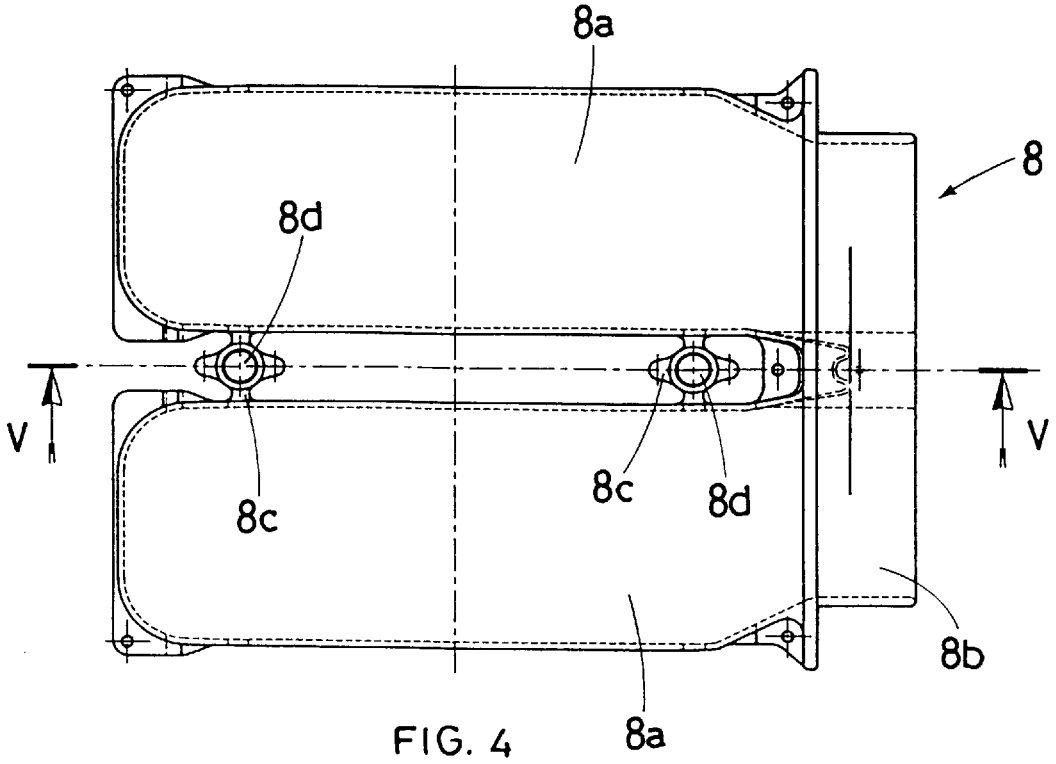
FIG. 4 is an external view of the top half-shell of the casing.
Figure 4A:
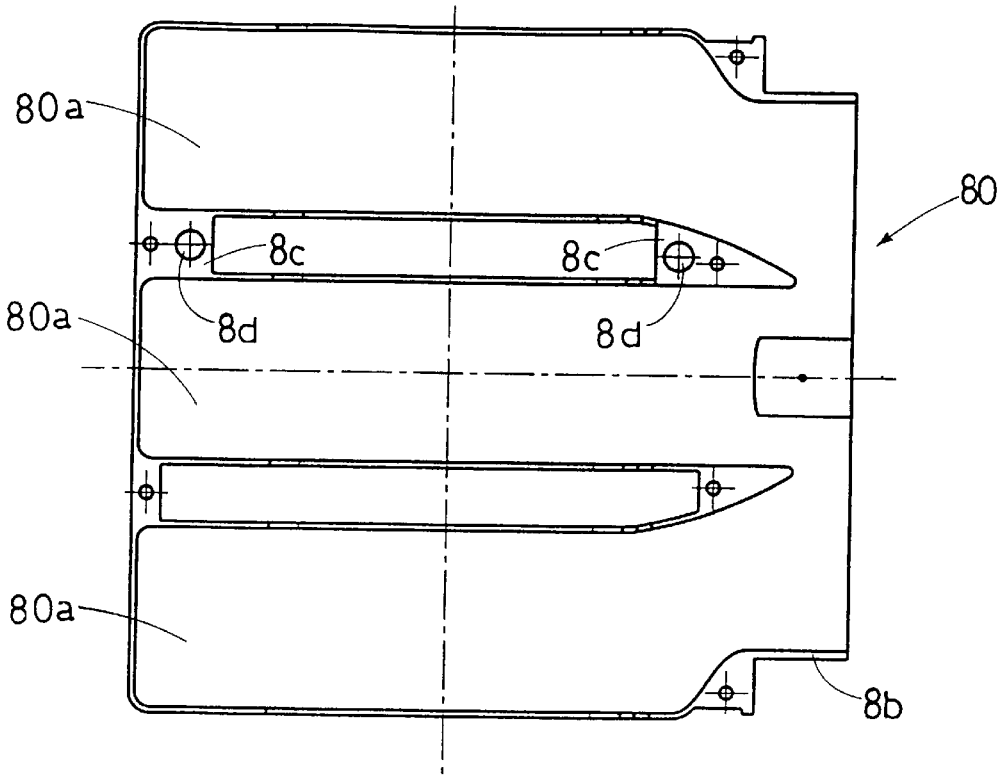
Figure 5A:
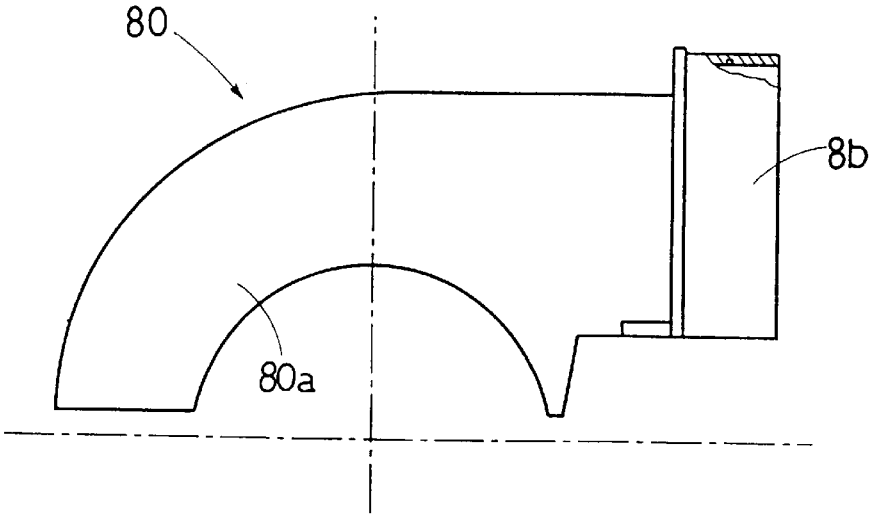

With particular reference to FIGS. 3, 4 and 5, the top half-shell (8) consists of two semi-augers assembled close to each other and parallel (8*a*) and by a semi-nosepiece (8*b*) which delimits at the top the outflow outlets (10) of the semi-augers (8*a*); two short connection crosspieces (8*a*) the centre of which are provided with bushings having vertical axis (8*d*) being provided in the space between said half-shells (8*a*).

With particular reference to FIGS. 3, 6 and 7 the bottom half-shell (9) consists of two semi-augers assembled close to each other and parallel (9*a*) and by a semi-nosepiece (9*b*) which delimits at the bottom the outflow outlet (10) of the semi-augers (9*a*); a single short crosspiece (9*c*) the centre of which is provided with a bushing having vertical axis (9*d*) being provided in the space between said half-shells (9*a*).

As mentioned previously, the two half-shells (8) and (9) are mounted on the motor unit, one from top to bottom and the other from bottom to top; in particular the top half-shell (8) must be fitted from the top in order to fit the two pins (4) projecting from the top of the cover (2), into the bushings (8*d*) positioned in the space between the half-shells (8*a*); the bottom half-shell (9) must be mounted from bottom to top so as to fit the pin (4) projecting from the bottom of cover (2) into the relevant bushing (9*d*) positioned in the space between the half-shells (9*a*).

Both the top half-shell (8) and the bottom half-shell (9) being provided with several gusset plates (11) having holes with vertical axis (11*a*) in corresponding positions around the mouth of the semi-augers (8*a* and 9*a*).

When casing (7) is assembled, each gusset plate (11) of the top half-shell (8) is abutted precisely against the corresponding gusset plate (11) of the bottom half-shell (9); at this point it is sufficient to fit the screws having vertical axis in holes (11*a*) of the various pairs of gusset plates (11) to fix the suction unit securely.

A detailed description of FIGS. 1A and 7A is considered to be superfluous since the only variation introduced in the second structural embodiment with respect to the first embodiment is the use of a top half-shell (80) having three adjacent semi-augers (80*a*) and a bottom half-shell (90) having three adjacent semi-augers (90*a*).

The second embodiment obviously has three fans (6) despite the fact that there is one motor (1).

In this regard it should be noted that the same numbers used in FIGS. 1–7 have been used in FIGS. 1A–7A in order to illustrate the corresponding structural components of the first and second embodiments of the invention.

I claim:

1. A suction unit having multiple augers of the type consisting of an electric motor (1) housed in a cylindrical cover (2) and crossed by a shaft on whose ends are splined several fans (6) each of which operates in an auger provided with a respective outflow outlet and being an integral part of the casing (7) that houses the entire fan-motor, characterised in that arms (3) placed at 120° and terminated with respective pins with a vertical axis (4) and enlarged end base (4*a*) project radially from the exterior of cover (2) and characterised by the use of a special casing (7) consisting of two identical half-shells (8 and 9 or 80 and 90) each of which consists of two or more semi-augers assembled close to each other and parallel (8*a* and 9*a* or 80*a* and 90*a*) and by a semi-nosepiece (8*b* and 9*b*) which delimits the outflow outlets (10) of the semi-augers (8*a* and 9*a* or 80*a* and 90*a*); it being provided that between the adjacent semi-augers (8*a* and 9*a* or 80*a* and 90*a*) of each half-shell (8 and 9 or 80 and 90) there are spaces in proximity of which connection crosspieces (8*c* and 9*c*) are provided having center bushings with a vertical axis (8*d* and 9*d*) positioned so as to join precisely with pins (4) projecting from cover (2) of motor (1) when the two half-shells (8 and 9 or 80 and 90) are drawn close to each other and coupled, one (8 or 80) from the top and the other (9 or 90) from the bottom, to the fan-motor unit; it being provided moreover that the two half-shells ( 8 and 9 or 80 and 90) have several gusset plates (11) with holes having a vertical axis (11*a*) fitted externally and around the mouth of the semi-augers (8*a* and 9*a* or 80*a* and 90*a*) in precisely corresponding positions).

2. A multiple auger suction unit according to claim 1 characterised in that the radial arms (3) projecting from the cover (2) are housed in a disk (5) placed edgewise outside the walls of the cover (2).

* * * * *